US007316292B2

(12) United States Patent
Morales et al.

(10) Patent No.: US 7,316,292 B2
(45) Date of Patent: Jan. 8, 2008

(54) SPUN EXTRUSION SIDE ENTRY MUFFLER

(75) Inventors: Anthony Morales, Columbus, IN (US); Alfred N. Tucker, Columbus, IN (US)

(73) Assignee: ET US Holdings LLC, Wilmington, DE (US)

( * ) Notice: Subject to any disclaimer, the term of this patent is extended or adjusted under 35 U.S.C. 154(b) by 342 days.

(21) Appl. No.: 11/107,345

(22) Filed: Apr. 15, 2005

(65) Prior Publication Data

US 2006/0231330 A1 Oct. 19, 2006

(51) Int. Cl.

| | |
|---|---|
| ***F01N 7/18*** | (2006.01) |
| *B21D 51/16* | (2006.01) |
| *B23P 17/02* | (2006.01) |
| *F01N 1/08* | (2006.01) |

(52) U.S. Cl. ..... 181/282; 181/272; 29/890.08

(58) Field of Classification Search ..... 181/282, 181/268, 269, 272, 275, 243, 241, 238; 29/890.08
See application file for complete search history.

(56) References Cited

U.S. PATENT DOCUMENTS

| | | | | |
|---|---|---|---|---|
| 1,906,953 | A * | 5/1933 | Enghauser | 29/890.08 |
| 2,323,891 | A * | 7/1943 | Blanchard | 181/238 |
| 2,457,890 | A * | 1/1949 | Hedrick | 181/238 |
| 2,841,236 | A * | 7/1958 | Moerke | 181/238 |
| 2,961,059 | A * | 11/1960 | Blair | 181/238 |
| 3,189,122 | A * | 6/1965 | Martin | 181/238 |
| 3,507,357 | A * | 4/1970 | Blome | 181/282 |
| 4,486,932 | A * | 12/1984 | Hall et al. | 29/890.08 |
| 4,663,812 | A * | 5/1987 | Clausen | 29/890.052 |
| 4,887,557 | A * | 12/1989 | Sukimoto et al. | 29/890.08 |
| 5,141,820 | A * | 8/1992 | Sukimoto et al. | 428/586 |
| 5,717,173 | A * | 2/1998 | Gerber et al. | 181/243 |
| 5,816,361 | A * | 10/1998 | Gerber | 181/243 |
| 5,949,035 | A * | 9/1999 | Herold | 181/282 |
| 6,131,696 | A * | 10/2000 | Esslinger | 181/224 |
| 6,241,044 | B1 * | 6/2001 | Nishiyama et al. | 181/272 |
| 6,308,799 | B1 * | 10/2001 | Konstantakopoulos | 181/282 |
| 6,341,664 | B1 * | 1/2002 | Gerber | 181/282 |
| 6,405,827 | B1 * | 6/2002 | Church | 181/243 |
| 6,796,402 | B1 * | 9/2004 | Wagner | 181/238 |
| 7,104,359 | B1 * | 9/2006 | Zelinski | 181/264 |
| 2005/0077104 | A1 * | 4/2005 | Flintham | 181/243 |
| 2005/0284691 | A1 * | 12/2005 | Voss et al. | 181/255 |
| 2006/0124384 | A1 * | 6/2006 | Tary et al. | 181/243 |

* cited by examiner

*Primary Examiner*—Edgardo San Martin
(74) *Attorney, Agent, or Firm*—Carlson, Gaskey & Olds

(57) ABSTRACT

By using a spun extrusion method to form a side entry exhaust inlet, a muffler can be completely stuffed and end caps can be spun onto opposing ends of the muffler on a high speed production line without interruptions. The side entry exhaust inlet is formed within a muffler shell at a position between the opposing ends. A spinning tool engages an internal peripheral area of the side entry exhaust inlet to form a spun extruded surface that extends outwardly from the muffler shell.

22 Claims, 3 Drawing Sheets

SPUN EXTRUSION SIDE ENTRY MUFFLER

TECHNICAL FIELD

The subject invention relates to a muffler that includes a side entry exhaust inlet formed from a spun extrusion method.

BACKGROUND OF THE INVENTION

Side entry mufflers include a muffler shell with an exhaust inlet positioned in the muffler shell between opposing shell ends. The exhaust inlet includes an extrusion that provides a connection interface for an exhaust inlet pipe. Typically, this extrusion extends outwardly from an outer shell surface and is formed with a press and die apparatus. A die is positioned against the muffler shell at a desired exhaust inlet opening position and a press applies pressure at a die and muffler shell interface to form the extrusion.

The use of this press and die method has several disadvantages. One disadvantage is that the extrusion must be formed in the muffler shell before internal muffler components, such as baffles, support tubes, etc. can be stuffed into the muffler shell. This requirement interrupts flow along a muffler production line. Any interruption in material or component flow on a high speed production line significantly increases cost. On a high speed production line for side entry mufflers, the muffler shell is first formed from shell blanks. Once formed, the muffler shell is moved offline to a press and die arrangement to form the extrusion for the exhaust inlet. The muffler shell is then returned to the production line to receive the internal muffler components. Due to this interruptive production process, this type of muffler configuration has traditionally only been used for low volume muffler lines that are dedicated to a single product.

Another disadvantage with extrusions formed with a press and die arrangement is material thinning. A base radius area of the extrusion has a tendency to thin out during pressing. This thinning at the base radius area reduces extrusion durability performance.

Thus, there is a need for a process for making a side entry exhaust inlet extrusion that can be incorporated into a high speed production line, and which has improved extrusion durability characteristics, as well as overcoming the other deficiencies with prior designs described above.

SUMMARY OF THE INVENTION

A side entry muffler includes an outer shell with an internal cavity extending between first and second ends. An exhaust inlet is formed in the outer shell and is positioned longitudinally between the first and second ends. A spun extruded portion is formed about the exhaust inlet with a spinning tool.

The spinning tool spins about an axis that is positioned offset from a center of the exhaust inlet. The spinning tool engages an inner circumferential area of the exhaust inlet at a line contact interface. The spinning tool is also pulled in a direction generally parallel to the axis to pull outer shell material outwardly to form the spun extruded surface. Multiple spinning passes and pulls are performed to provide a desired diameter and length for the exhaust inlet.

The outer shell is stuffed with internal muffler components such as baffles, support tubes, etc., and first and second end caps are attached to the first and second ends of the outer shell, respectively. The first end cap is spun into attachment with the outer shell to substantially enclose the internal cavity at the first end. The second end cap is spun into attachment with the outer shell to substantially enclose the internal cavity at the second end.

By using a spun extrusion method to form the exhaust inlet, the outer shell can be completely stuffed and end caps can be spun onto opposing ends of the outer shell on a high speed production line without interruptions. After the side entry mufflers have been produced, side entry extrusions can be pulled, and other offline connections can be performed, such as attachment of tail pipes and exhaust inlet pipes, for example. Another benefit provided by forming side entry extrusions with a spinning process is that there is minimal thinning at a base radius area of the extrusion. This significantly improves extrusion durability performance.

These and other features of the present invention can be best understood from the following specification and drawings, the following of which is a brief description.

DETAILED DESCRIPTION OF THE PREFERRED EMBODIMENT

Figure 1:
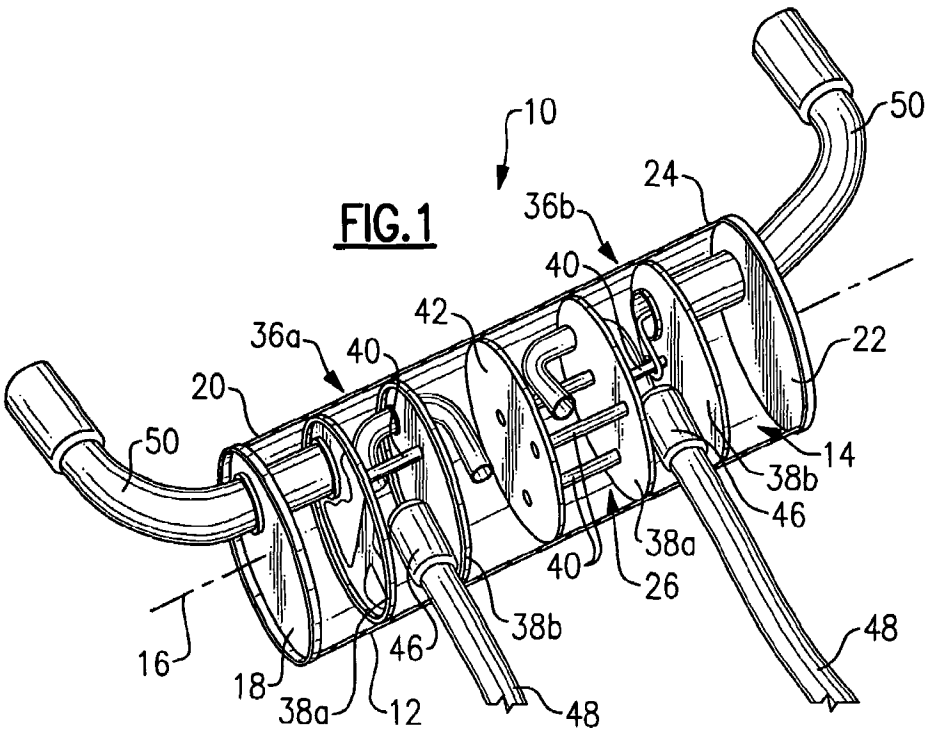
FIG. 1 is a perspective view of a side entry muffler assembly produced by a process incorporating the subject invention.

A muffler is shown generally at 10 in FIG. 1. The muffler 10 includes an outer shell 12 forming an internal cavity 14. The outer shell 12 extends along a longitudinal axis 16 that extends along a length of the muffler 10. The outer shell 12 includes a first end cap 18 at a first shell end 20 and a second end cap 22 at a second shell end 24. Internal muffler components, shown generally at 26 are stuffed inside the internal cavity 14 prior to the first 18 and second 22 end caps being attached to the outer shell 12. This will be discussed in greater detail below.

Figure 2:
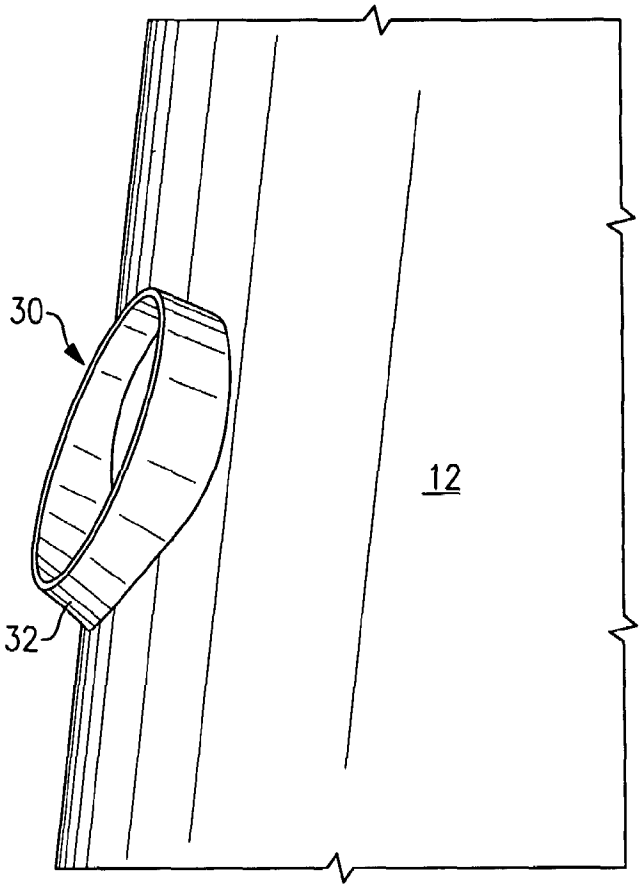
FIG. 2 is a perspective view of a spun extruded exhaust inlet on a muffler assembly.

The muffler 10 includes a side entry exhaust inlet 30, shown in FIG. 2, which is formed within the outer shell 12 at a position between the first 20 and second 24 shell ends. The side entry exhaust inlet 30 includes a spun extruded portion 32 that extends outwardly from an external surface 34 of the outer shell 12. The spun extruded portion 32 extends around an entire periphery of the side entry exhaust inlet 30. The spun extruded portion 32 is formed during a unique spinning process that allows the muffler to be produced on a high speed muffler assembly line. This will be discussed in greater detail below.

In the example shown in FIG. 1, the muffler 10 includes two (2) side entry exhaust inlets 30 (FIG. 3), however, it should be understood that unique process could be used for any type of side entry muffler including single inlet side entry mufflers. Further, the internal muffler components 26 can be comprised of many different configurations. FIG. 1 depicts just one example of an internal configuration for the muffler 10.

In this configuration, the outer shell 12 houses two (2) sets of internal muffler components, shown generally at 36*a*, 36*b*, with each set of internal muffler components 36*a*, 36*b* having one side entry exhaust inlet 30. Each set of internal muffler components 36*a*, 36*b* includes a pair of support baffles 38*a*, 38*b* that are positioned within the internal cavity 14 and are spaced apart from each other. Support tubes 40 extend between each pair of support baffles 38*a*, 38*b*. The support tubes 40 maintain a desired distance between adjacent baffles 38*a*, 38*b*. A center baffle 42 separates the two sets of internal muffler components 36*a*, 36*b*. Support tubes 40 could also be used to maintain a desired distance between one or both of the pairs of support baffles 38*a*, 38*b* and the center baffle 42.

A connector tube 46 is supported by the outer shell 12. The connector tube 46 is coupled to an exhaust inlet pipe 48 at the side entry exhaust inlet 30. Other internal muffler components are optionally supported by each pair of support baffles 38*a*, 38*b*.

The first 18 and second 22 end caps substantially enclose the two sets of internal muffler components 36*a*, 36*b* within the internal cavity 14 of the outer shell 12. An exhaust outlet pipe or tail pipe 50 is then connected to each of the first 18 and second 22 end caps. The subject muffler 10 could also be configured to only include one tail pipe 50.

Figure 3:
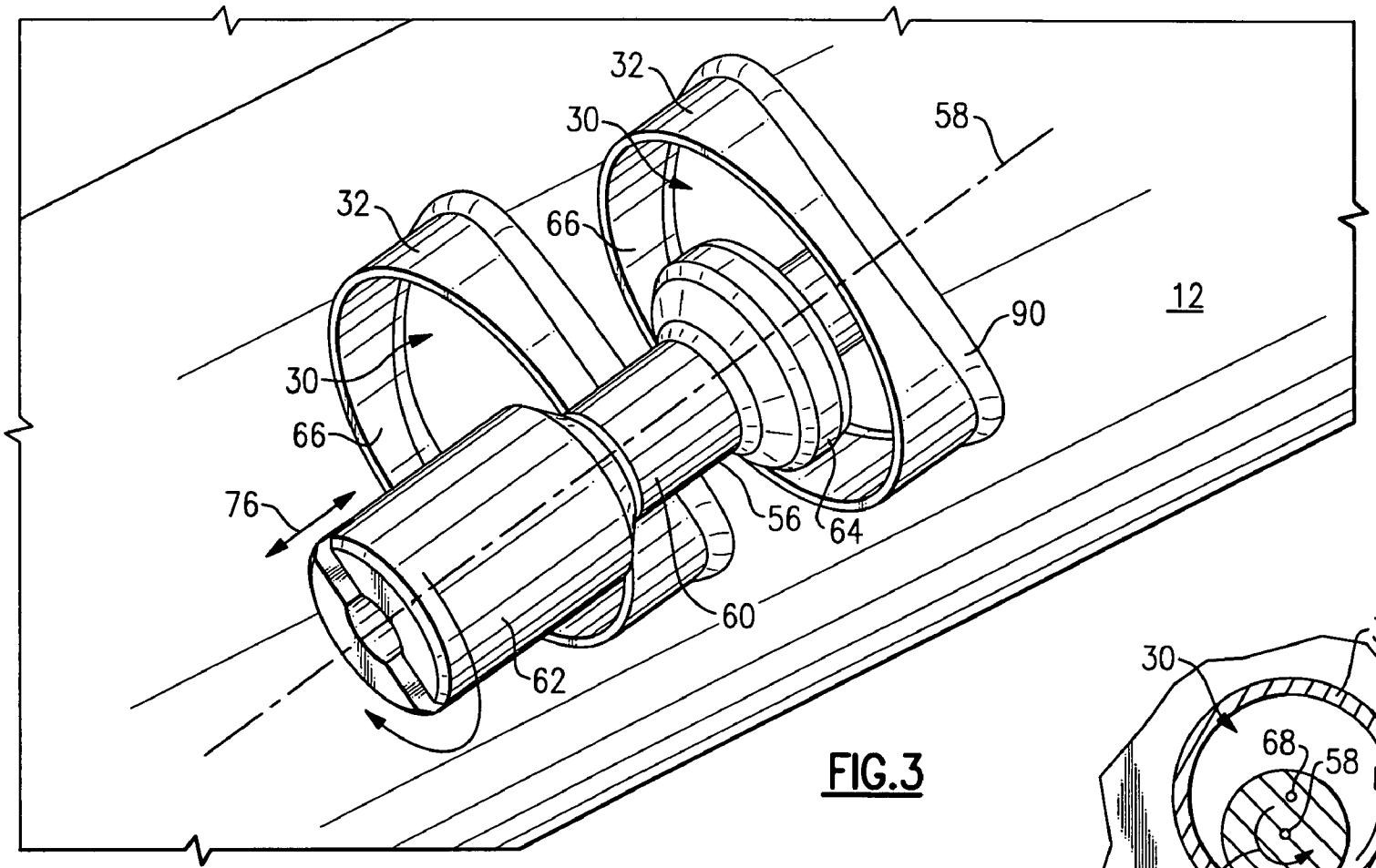
FIG. 3 is a perspective view of a tool used to form the spun extruded exhaust inlet of FIG. 2.

As discussed above, the muffler 10 includes a spun extruded portion 32 that is formed by a unique process that allows the muffler 10 to be produced on a high speed muffler assembly line without interruptions. This process utilizes a tool 56 that spins about a tool axis 58, as shown in FIG. 3. The tool 56 includes a shaft portion 60 with a tool mount 62 positioned at one end. The tool mount 62 is adapted for connection to a machine (not shown) that spins and moves the tool 56 linearly along the tool axis 58.

Figure 4:
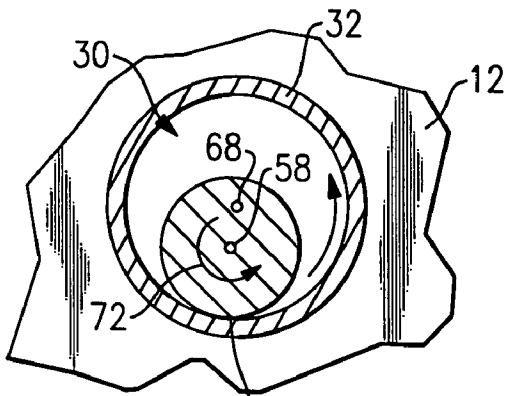
FIG. 4 is a schematic view of the tool and spun extruded exhaust inlet of FIG. 3.

The tool 56 also includes an increased diameter portion 64 that engages an internal peripheral surface 66 at an edge of an opening defining the side entry exhaust inlet 30. The tool 56 spins about the tool axis 58 at a position that is offset from a center axis 68 (FIG. 4) of the opening defining the side entry exhaust inlet 30. The tool 56 moves about the entire internal peripheral surface 66 of the side entry exhaust inlet, as indicated at arrow 70 in FIG. 4, to make a complete spinning pass.

As the tool 56 spins about tool axis 58, as indicated by arrow 72, line contact is maintained between the inner peripheral surface 66 and the increased diameter portion 64, as indicated at 74. The tool 56 is also pulled in a linear direction generally parallel to the tool axis 58, as indicated by arrow 76 in FIG. 3. By pulling the tool 56, material about the side entry exhaust inlet 30 is pulled or extruded outwardly from the outer shell 12. This spun extruded portion 32 forms a connection interface for the exhaust inlet pipe 48. Multiple spinning passes and pulls are performed until a desired spun extruded length and diameter is achieved at the side entry exhaust inlet 30. The diameter and length can vary depending on the type of muffler assembly and vehicle application as needed.

Another benefit provided by forming side entry extrusions with a spinning process is that there is minimal thinning at a base radius area 90 of the spun extruded portion 32 (see FIG. 3). This significantly improves extrusion durability performance.

Figure 5:
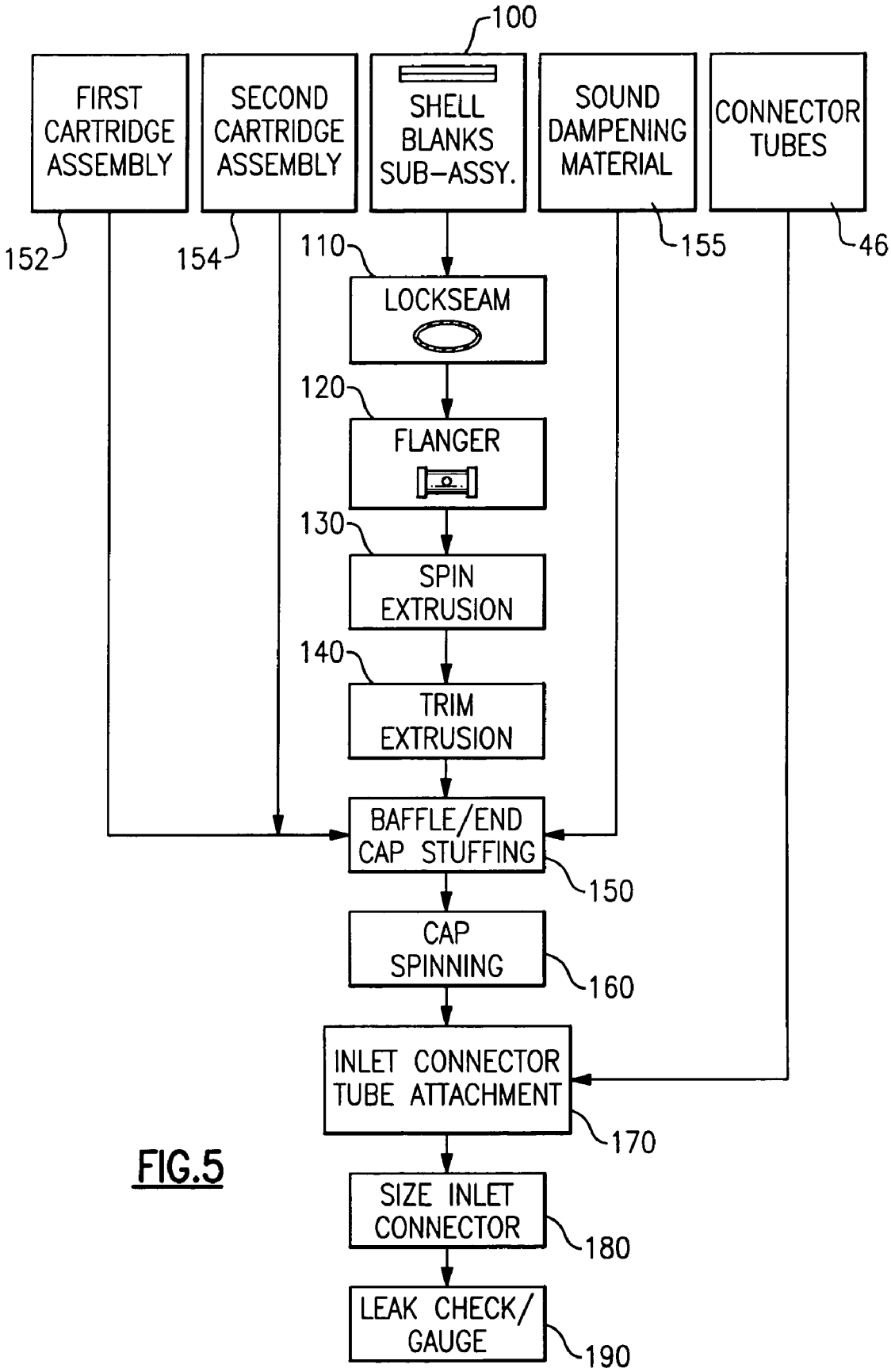
FIG. 5 is a process flow chart indicating steps used to form the side entry muffler assembly.

This extrusion process can easily be incorporated into a high speed muffler production line. A flow chart detailing various steps in the production line is shown in FIG. 5. First, two pieces of thin sheet metal are spot welded together to form a shell blank, as indicated at 100. This shell blank is rolled to form the outer shell 12. The shell blank preferably includes at least one opening that is used for the side entry exhaust inlet 30. Edges of the shell blank are attached to each other with a lockseam process, as indicated at 110. Next, the first 20 and second 24 shell ends are subjected to a flange forming process, which provides shells ends that can accept the first and second end caps, as indicated at 120.

Next, the side entry exhaust inlet 30 is subjected to a spin extrusion process, as indicated at 130. This spin extrusion process utilizes the tool 56 as described above. Next, an optional trimming step is performed at 140. The trimming step can be used to trim the length of the spun extruded portion 32 to a desired length. This trimming step may not be necessary as the number of pulls and passes performed by the tool 56 can be controlled to achieve the desired length without requiring any trimming.

Next, the internal muffler components 26 are stuffed into the internal cavity 14 of the outer shell, as indicated at 150, and sound dampening material is also inserted into the outer shell 12 as indicated at 155. In the example shown, a first cartridge assembly 152 is stuffed into the outer shell 12 at the first shell end 20 and a second cartridge assembly 154 is stuffed into the outer shell 12 at the second shell end 24. The first 152 and second 154 cartridge assemblies typically include all of the internal muffler components except for the connector tubes 46 and tail pipes 50. The first 18 and second 22 end caps may optionally be included as part of the first 152 and second 154 cartridge assemblies.

Once the first 152 and second 154 cartridge assemblies have been stuffed into the outer shell 12, the first 18 and second 22 end caps are attached to the first 20 and second 24 shell ends to substantially enclose the first 152 and second 154 cartridge assemblies in the internal cavity 14. The first 18 and second 22 end caps are attached with an end cap spin process, as indicated at 160. This end cap spin process is well-known in the art and will not be discussed in further detail.

Next the connector tubes 46 are attached to the outer shell 12 as indicated at 170. Next, an inlet connector member is sized, as indicated at 180, and then a leak check is performed as indicated at 190.

It should be noted that while the spin extrusion process indicated at 130 is shown as occurring prior to stuffing of the first 152 and second 154 cartridge assemblies into the outer shell 12, the spin extrusion process could optionally be performed after the stuffing process. In either configuration, the entire muffler 10 can be formed on a high speed production line without interruptions that traditionally occur with press and die formed side entry exhaust inlets.

In one example process, the muffler 10 is completely stuffed and the first 18 and second 22 end caps are spun onto the first and second shell ends to form a side entry muffler assembly. The spun extruded portion 32 at the side entry exhaust inlet 30 can then be produced with the tool 56 and additional pipe connections (inlet pipes, tail pipes, etc.) can be done in an offline process.

Also, while the spun extruded portion 32 is shown as being formed at the side entry exhaust inlet 30, it should be understood that the a similar spun extruded portion could be used for other types of component connections to the outer shell 12, including tail pipe or outlet pipe connections, for example.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A muffler comprising:

a shell including an internal cavity, said shell defining a longitudinal axis that extends between first and second ends;

a first end cap substantially enclosing said internal cavity at said first end;

a second end cap substantially enclosing said internal cavity at said second end; and an exhaust inlet formed within said shell at a position between said first and second ends, said exhaust inlet having a spun extruded surface extending outwardly from said shell.

2. The muffler according to claim 1 wherein said spun extruded surface extends in a direction transverse to said longitudinal axis.

3. The muffler according to claim 1 wherein said first and said second end caps include a spun attachment interface to said shell.

4. The muffler according to claim 1 wherein said exhaust inlet defines an inlet center and wherein said spun extruded surface is formed from a tool that spins about an axis that is offset from said inlet center.

5. The muffler according to claim 1 wherein said spun extruded surface extends about an entire perimeter of said exhaust inlet.

6. The muffler according to claim 1 including first and second baffles, and at least one support tube extending between said first and second baffles to maintain a desired distance between said first and second baffles, wherein said first and second baffles and said at least one support tube form a cartridge subassembly that is stuffed into said internal cavity.

7. The muffler according to claim 6 wherein at least one of said first and said second end caps is included in said cartridge subassembly.

8. A method of forming a muffler comprising the steps of:

(a) forming an outer shell with an internal cavity extending between first and second shell ends;

(b) forming an exhaust inlet in the outer shell at a position between the first and second shell ends; and (c) spinning a tool against an inner peripheral area of the exhaust inlet to form a spun extruded surface about the exhaust inlet.

9. The method according to claim 8 wherein the exhaust inlet has an inlet opening center and wherein step (c) includes spinning the tool about a rotational axis that is offset from the inlet opening center.

10. The method according to claim 9 wherein step (c) includes pulling the tool in a direction generally parallel to the rotational axis to pull outer shell material outwardly from the outer shell to form the spun extruded surface.

11. The method according to claim 10 wherein step (c) is performed a plurality of times to provide a desired exhaust inlet diameter and a desired spun extruded surface length.

12. The method according to claim 8 wherein step (c) includes maintaining line contact between an outer peripheral surface of the tool and the inner peripheral area during spinning.

13. The method according to claim 8 wherein step (a) includes spot welding a pair of metal sheets to each other to form a shell blank, rolling the shell blank into a desired muffler body shape, and attaching edges of the shell blank to each other to form a lockseam; forming first and second flanges at the first and second shell ends of the outer shell; stuffing at least one internal muffler component subassembly into the internal cavity; spinning a first end cap against the first flange to substantially enclose the first shell end of the outer shell; and spinning a second end cap against the second flange to substantially enclose the second shell end of the outer shell.

14. A method of forming a muffler comprising the steps of:

(a) forming an outer shell with an internal cavity extending between first and second shell ends;

(b) forming a connection interface portion in the outer shell at a position between the first and second shell ends; and (c) spinning a tool against an inner peripheral area of the connection interface portion to form a spun extruded surface about the connection interface portion.

15. The method according to claim 14 including forming the connection interface portion as an exhaust inlet and wherein step (c) includes spinning the tool against the inner peripheral area of the exhaust inlet to form a spun extruded surface about the exhaust inlet.

16. The method according to claim 14 wherein the connection interface portion has an opening center and wherein step (c) includes spinning the tool about a rotational axis that is offset from the opening center.

17. The muffler according to claim 1 including an exhaust outlet that is connectable to a vehicle tail pipe, wherein vehicle exhaust gases are to flow through said internal cavity from said exhaust inlet to said exhaust outlet.

18. The muffler according to claim 1 wherein said shell includes an initial inlet opening defined by a first diameter and having a contact surface to be engaged by a spinning tool having a second diameter at said contract surface that is less than said first diameter, and wherein said shell includes a final inlet opening defined by said spun extruded surface that extends from a base radius area that provides a curved transition surface from said shell to said spun extruded surface to form said exhaust inlet.

19. The method according to claim 8 including providing the muffler with an exhaust gas outlet connectable to a vehicle tail pipe such that vehicle exhaust gases will flow from the exhaust inlet, through the internal cavity, and out the exhaust gas outlet.

20. The method according to claim 8 wherein step (b) includes providing at least one side-entry opening for the exhaust inlet in a shell blank used to form the outer shell wherein the at least one side-entry opening is defined by a first diameter, and wherein step (c) includes engaging an inner surface of the at least one side-entry opening with the tool at a contact interface wherein the tool is defined by a second diameter at the contact interface that is less than the first diameter, and spinning the tool against the inner surface to form the spun extruded surface.

21. The method according to claim 14 including forming the connection interface portion as one of an exhaust gas inlet and an exhaust gas outlet, and providing another connection interface to comprise the other of the exhaust gas inlet and the exhaust gas outlet such that vehicle exhaust gases will flow from the exhaust gas inlet, through the internal cavity, and out the exhaust gas outlet.

22. The method according to claim 14 wherein the connection interface portion is defined by a first diameter and wherein step (c) includes engaging the inner peripheral area with the tool at a contact interface wherein the tool is defined by a second diameter at the contact interface that is less than the first diameter, and spinning the tool against the inner peripheral area to form the spun extruded surface.

* * * * *